US006792621B2

(12) United States Patent
Braun

(10) Patent No.: US 6,792,621 B2
(45) Date of Patent: Sep. 21, 2004

(54) GARMENT VENTILATION SYSTEM

(75) Inventor: David Braun, Milwaukee, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 137 days.

(21) Appl. No.: 09/902,546

(22) Filed: Jul. 10, 2001

(65) Prior Publication Data

US 2003/0013368 A1 Jan. 16, 2003

(51) Int. Cl.[7] ..... A41D 1/00

(52) U.S. Cl. ..... 2/93; 2/1; 2/95; 2/96; 2/97; 2/98; 2/99; 2/100; 428/33.52; 428/53; 428/99; 428/193; 428/223; 428/908.8; 442/76; 442/79; 442/85; 442/86; 442/149; 442/168

(58) Field of Search ..... 2/1, 456, 2.14, 2/2.15, 2.16, 2.17, 59, 93, 95, 96, 97, 98, 99, 100; 428/33, 52, 53, 99, 193, 223, 908.8; 442/76, 79, 85, 86, 149, 168

(56) References Cited

U.S. PATENT DOCUMENTS 4,143,197 A 3/1979 Jasionowicz et al.
4,933,231 A 6/1990 Seber
5,845,336 A * 12/1998 Golde ..... 2/93
6,237,152 B1 * 5/2001 Gootrad ..... 2/87
6,263,510 B1 * 7/2001 Bay et al. ..... 2/93

OTHER PUBLICATIONS

Harley–Davidson Motorclothes Apparel & Accessories Fall 1997; p. 2, "Nevada Jacket".
Harley–Davidson Motorclothes Apparel & Accessories Fall 1997; p. 4, "Men's Perforated Jacket".
Harley–Davidson Motorclothes Apparel & Accessories Fall 1997; p. 4, "Women's Perforated Jacket".
Harley–Davidson Motorclothes Apparel & Accessories Fall 1997; p. 19, "Short Touring Jacket".
Harley–Davidson Motorclothes Apparel & Accessories Fall 1997; p. 19, "3/4 Touring Jacket".

* cited by examiner

*Primary Examiner*—Arti R. Singh
(74) *Attorney, Agent, or Firm*—Michael Best & Friedrich LLP

(57) ABSTRACT

An article of clothing includes a waterproof inner fabric layer and an outer fabric layer. An outer opening is defined in the outer fabric layer and is selectively opened and closed by a standard zipper. A portion of the inner fabric layer extends between the edges of the outer opening and defines an inner opening. The inner opening is selectively opened and closed by a water-resistant zipper. Venting material extends between the edges of the inner opening and allows air to flow through the inner opening when both the inner and outer openings are opened.

12 Claims, 3 Drawing Sheets

58
90
98
78
60
82
102
74
100
90
62
106
78
70
94
86
66

GARMENT VENTILATION SYSTEM

FIELD OF THE INVENTION

The present invention relates to a garment ventilation system particularly for use on motorcycles or similar vehicles where it is desirable for the garment to be changeable from a waterproof configuration to a ventilated configuration, and where protection from abrasive injury is of concern.

BACKGROUND OF THE INVENTION

It is known in the art to provide a waterproof garment for protection from rain or vehicle spray when riding in inclimate weather on motorcycles or other open-air vehicles. These garments are typically made of impermeable materials such as various plastics or GORTEX™ brand breathable, waterproof fabric. It is also well known in the art to provide a durable, abrasion resistant garment for protection from abrasive injuries that may result due to a fall from a motorcycle or similar vehicle. These garments have typically been made of leather or other heavy materials that resist tearing.

In order to provide a versatile garment that is both waterproof and protective, manufacturers typically use a combination of materials such that one portion of the garment provides abrasion resistance and another portion of the garment is waterproof. It is also well known in the art to provide vents on the garment promoting airflow through the garment when water impermeability is not a concern in order to cool the wearer of the garment. Many prior art garments provide the above listed properties but often the combined demands of an effective ventilation system and water impermeability create modestly effective, difficult to use, and poorly fitting garments.

The goal of the present invention is to provide a garment that is abrasion resistant, waterproof, and well ventilated. A further goal of the present invention is for the ventilation system of the garment to be easily adjusted while operating a vehicle such as a motorcycle and for the fit of the garment to be modifiable based on the degree of ventilation desired.

SUMMARY

The present invention provides an article of clothing having an outer fabric layer with an outer opening and an inner fabric layer with an inner opening coupled to the outer fabric layer. The inner fabric layer is substantially waterproof and a water-resistant closure is coupled to the inner fabric layer along the inner opening.

In one embodiment, the outer fabric layer of the article of clothing is made of an abrasion-resistant nylon, and the inner fabric layer is made of a waterproof polymer-coated nylon. The inner opening is preferably aligned with the outer opening and the water-resistant closure may be movable between an open position, which allows air to pass through the inner opening, and a closed position, which substantially prevents water from passing through the inner opening. The water-resistant closure is preferably a water-resistant zipper. Venting material having several small holes may be secured to the inner fabric layer and may cover a portion of the inner opening to allow air to flow through the interior of the jacket.

The article of clothing may be made by forming an outer opening in an outer fabric layer and forming an inner opening in an inner fabric layer. The inner fabric layer may be attached to the outer fabric layer such that it extends across the outer opening. A water-resistant closure may be provided to selectively open and close the inner opening. The inner opening may be aligned with the outer opening and venting material may be attached such that it extends across the inner opening.

Other features and advantages of the invention will become apparent to those skilled in the art upon review of the following detailed description, claims, and drawings.

Figure 1:
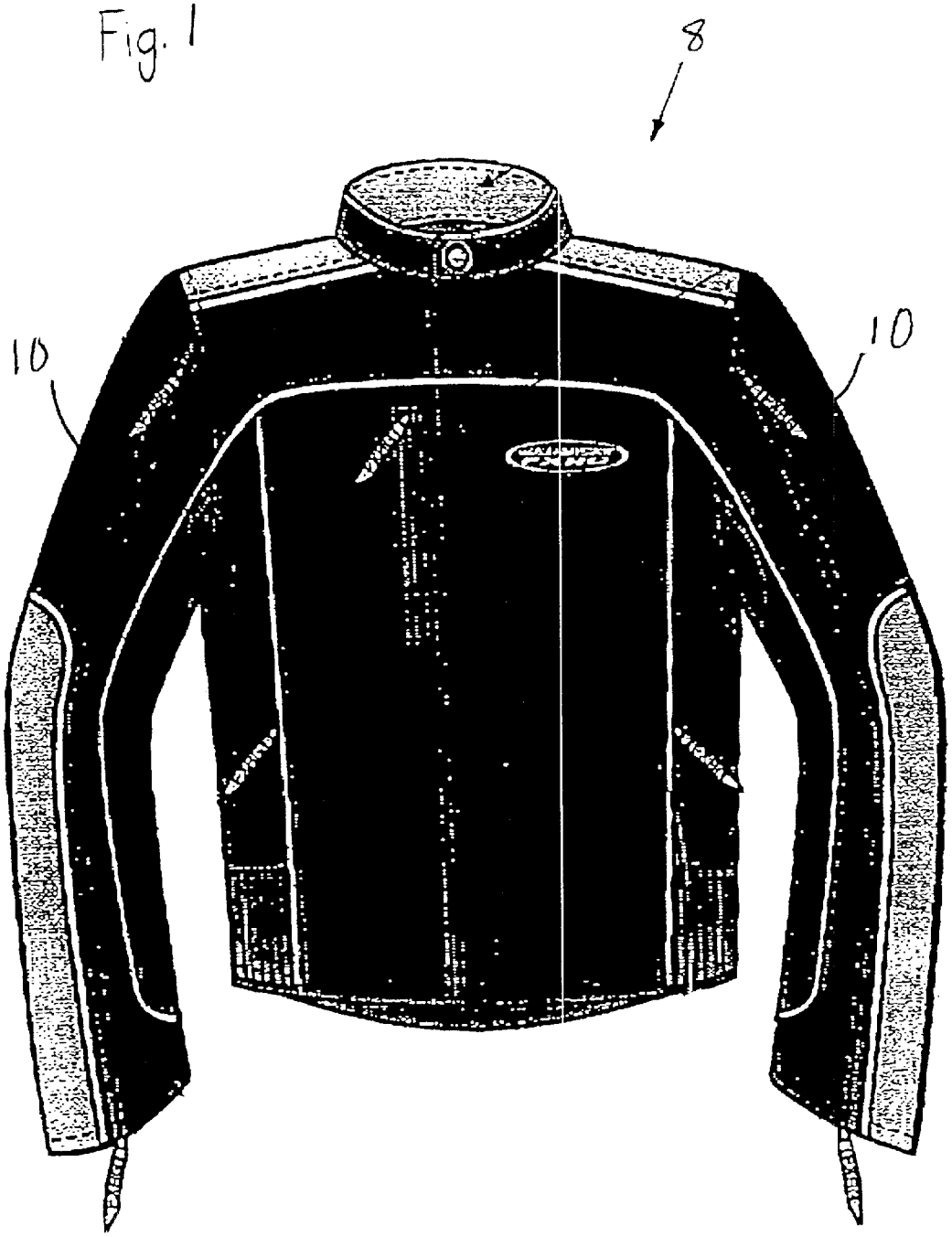
FIG. 1 is a front view of a jacket including a ventilation system embodying the current invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

Figure 2:
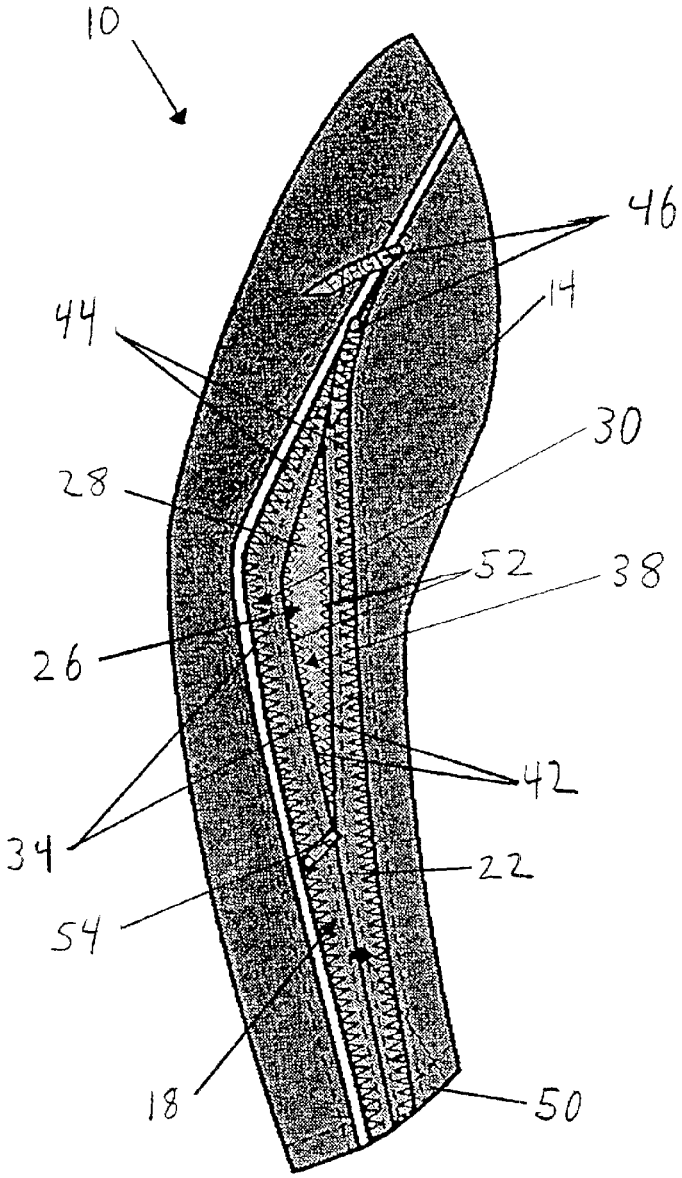
FIG. 2 is an enlarged view of the sleeve of the jacket illustrated in FIG. 1.

FIGS. 1 and 2 illustrate a motorcycle jacket 8 including the ventilation system of the current invention embodied in a jacket sleeve 10. The sleeve 10 includes an outer layer in the form of an abrasion-resistant fabric 14 defining an outer opening 18. An inner layer in the form of a waterproof fabric 22 extends across the outer opening 18 and defines an inner opening 26. A layer of venting material 28 extends across the inner opening 26 and includes a plurality of holes (not shown). An outer closure in the form of a standard zipper 30 is adapted to close the edges 34 of the outer opening 18, and an inner closure in the form of a water-resistant zipper 38 is adapted to close the edges 42 of the inner opening 26.

The sleeve 10 is preferably constructed such that the abrasion-resistant fabric 14 protects the wearer in case of a fall but is not necessarily water impermeable. The abrasion-resistant fabric 14 may include natural materials such as leather, recently developed synthetics, or other suitable materials offering similar wear protection. The waterproof fabric 22 is preferably adapted to be comfortable and non-abrasive as it may often come into direct contact with the wearer's skin. The waterproof fabric 22 and abrasion-resistant fabric 14 are generally stitched together such that they form one continuous jacket 8 in the traditional configuration. However, the current invention is readily adaptable to the style of jackets having a removable inner liner that either zips to, or is otherwise removably attached to the outer layer based on the degree of weather protection desired. In the current embodiment the inner and outer openings 26, 18 of the ventilation system are located on the medial portions of each jacket sleeve 10 and are oriented in a substantially longitudinal direction with respect to the sleeves 10. It should be apparent to one of ordinary skill in the art that the ventilation system disclosed herein may be located or orientated in a number of ways on the jacket 8 or any other article of clothing where selective water-impermeability and air-permeability is desired without escaping the scope and spirit of the current invention.

The standard zipper 30 includes joinable rows of zipper teeth 44 and a zipper closure 46 that may be used to engage and disengage the rows of zipper teeth 44, selectively converting the outer opening 18 between the opened and closed configuration. In a highly preferred embodiment the edges 34 of the outer opening 18 extend from a position generally associated with the center of a wearers upper arm to the terminal end or cuff 50 of the jacket sleeve 10. The outer opening 18 most preferably includes two zipper closures 46 such that the outer opening 18 may be opened from either end and selectively adjusted to a plurality of partially opened configurations.

The waterproof fabric 22 is coupled to and extends across the outer opening 18 of the abrasion-resistant fabric 14 allowing the edges 34 of the outer opening 18 to separate when the zipper teeth 44 are not engaged. The inner fabric layer 22 also substantially completely lines the interior of the sleeve 10 and jacket 8 such that the entire jacket 8 is substantially waterproof. When the outer opening 18 is closed, the inner fabric layer 22 is gathered and folded such that it lies between the outer fabric layer 14 and the wearer's arm.

In the illustrated embodiment, the inner opening edges 42 are substantially aligned with the outer opening edges 34 and extend generally from an area associated with the middle of a wearer's upper arm to the middle of a wearer's forearm. The water-resistant zipper 38 includes joinable rows of specially designed water-resistant zipper teeth 52 and a water-resistant zipper closure 54 that may be used to selectively engage the rows of water-resistant zipper teeth 52. Adjusting the water-resistant zipper 38 converts the inner opening 26 from the opened, ventilated configuration to the closed, waterproof configuration and vice-versa. Although the current embodiment of the invention includes one water-resistant zipper 38, additional closures may be added or substituted as desired (e.g., by another water-resistant closure such as a zip-lock closure).

The section of venting material 28 extending across the inner opening 26 includes a plurality of holes allowing substantially unrestricted flow of air therethrough while preventing large debris from entering the interior of the sleeve 10. The venting material 28 is generally stitched to each inner opening edge 42 and is preferably configured such that an excess of venting material 28 allows the inner opening edges 42 to be spread apart when opened, facilitating additional airflow through the inner opening 26. When the inner opening 26 is closed the venting material 28 folds substantially in half forming a pleat that lies beneath the surface of the waterproof fabric 22.

Figure 3:
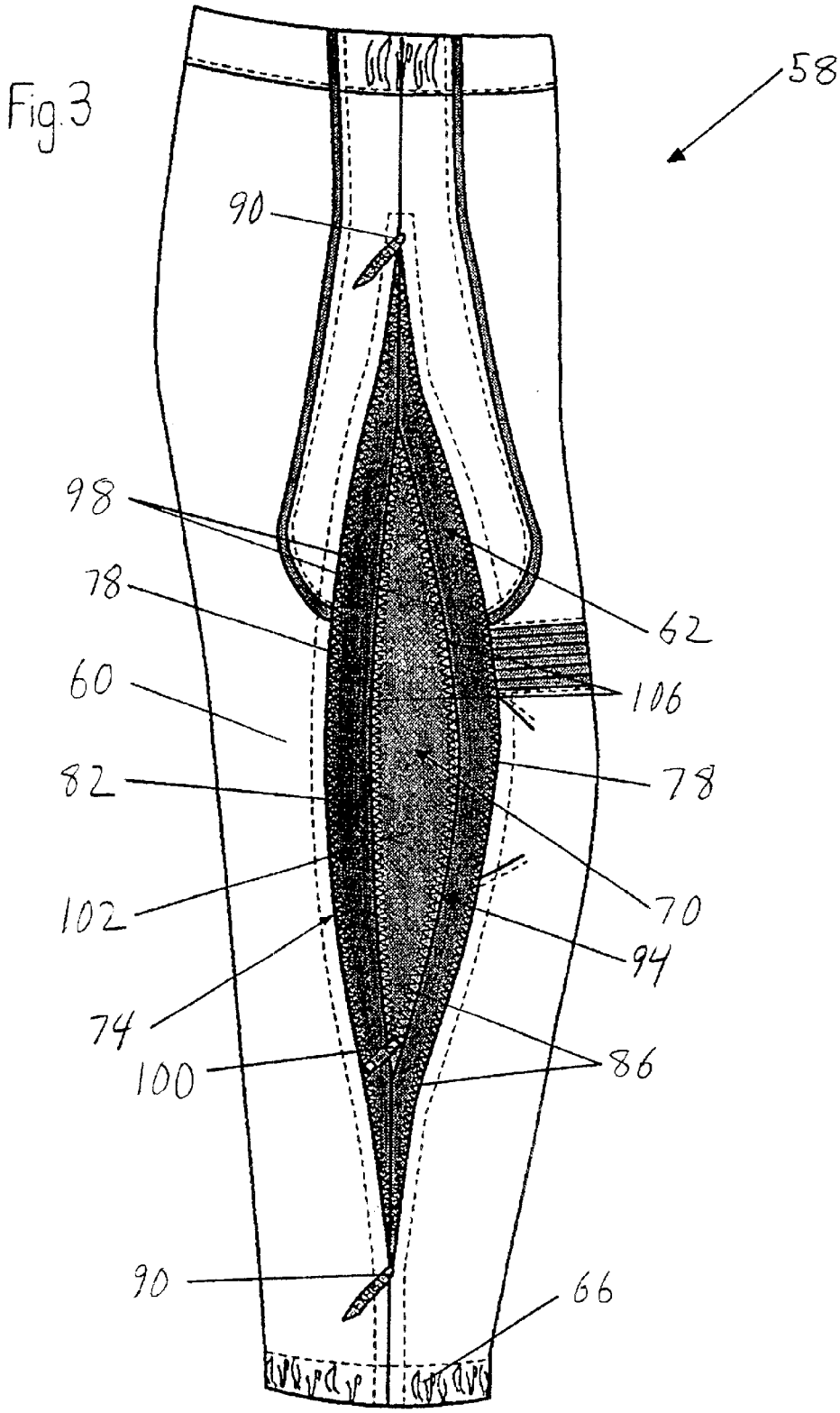
FIG. 3 is a side view of the ventilation system of the current invention embodied in a pant leg.

FIG. 3 illustrates another embodiment of the current invention in the form of a leg 58 of otherwise traditional motorcycle riding pants. In this embodiment, an outer opening 62 is defined in an abrasion-resistant fabric 60 and extends from an area substantially associated with a wearer's hip and continues to a pant cuff 66 nearest the wearer's foot. An inner opening 70 is substantially aligned with the outer opening 62 and extends from an area substantially associated with the middle of a wearer's thigh to the middle of a wearer's shank. In this embodiment, the construction of the inner opening 70 and outer opening 62 is substantially the same as the previously described embodiment in the form of a sleeve 10. The outer opening 62 is selectively closed with a standard zipper 74 including engageable rows of zipper teeth 78. A waterproof fabric 82 extends between the outer opening edges 86 allowing the edges 86 to separate when the outer opening 62 is opened. Two zipper closures 90 associated with the outer opening 62 are adapted for varying the configuration of the outer opening 62 from fully closed, to fully open, or to a plurality of partially open positions. The inner opening 70 is selectively closed with a water-resistant zipper 94 including engageable rows of water-resistant zipper teeth 98, a water-resistant zipper closure 100 is used to engage or disengage the rows of water-resistant zipper teeth 98, however additional closures may be added or substituted as desired (e.g., by another water-resistant closure such as a zip-lock closure). Venting material 102 having a plurality of small holes (not shown) extends between the inner edges 106 of the inner opening 70 and allows air to flow therethrough.

Both the standard zippers 30, 74 of the outer openings 18, 62 and the water-resistant zippers 38, 94 of the inner openings 26, 70 are easily and efficiently opened and closed with one hand. This is especially important when the garments are used on motorcycles because it allows the wearer to safely and conveniently adjust the openings while riding.

It is well known in the art that a certain amount of "billowing" typically occurs in motorcycle apparel under normal operating conditions. Billowing results when turbulent air passes through the garment either intentionally through vents, or unintentionally through inadequate garment closures (e.g. loose cuffs, waistbands, necklines, etc.) causing the material of the garment to flap. Billowing is often annoying and distracting to a rider, as such, it is generally preferred to minimize billowing in motorcycle garments. However, billowing also greatly increases airflow through a garment and is thus an effective method for cooling the rider in hot weather. The ventilation system of the current invention as embodied in either a motorcycle jacket sleeve 10 or pant leg 58 offers a unique solution for adjusting the amount of billowing based on the amount of airflow and subsequent cooling that is desired. While the specific configuration of zipper closures may vary between the sleeve 10 and the pant leg 58, both embodiments have similar a similar degree of adjustability; therefore only the sleeve 10 is discussed below.

The zipper closures 46 of the outer opening 18 are configured such that when the outer opening 18 is in the fully closed configuration one of the zipper closures 46 is at an upper end of the opening 18, near the wearer's shoulder, and the other zipper closure 46 is at a lower end of the opening 18, near the wearer's wrist. In this first configuration the jacket sleeve 10 has a minimum diameter throughout its length, in particular, the cuff 50 is substantially snug around the wearer's wrist, preventing airflow into the sleeve 10. The combination of a snug fit at the cuff 50 and a minimum diameter throughout the sleeve 10 results in a minimum amount of billowing of the jacket 8. The first configuration is ideal for high-speed travel in cold to mild temperatures or any travel involving rain. The snug fit of the cuff 50 also prevents the sleeve 10 of the jacket 8 from moving up the wearer's arm.

If more billowing is desired the wearer may adjust the zipper closures 46 such that both closures 46 are located near the cuff 50 of the sleeve 10. This will disengage the zipper teeth 44 along the entire length of the outer opening 18 except for a small portion near the wearer's wrist. In this second configuration the central portion of the sleeve 10 has a maximum diameter and may flap freely in the wind, aiding in the circulation of air within the jacket. The cuff 50 remains snug around the wearer's wrist or ankle preventing the entry of air or water therethrough. The second configuration is ideal for slightly elevated temperatures where a small degree of circulation within the garment is desired and water impermeability may still be of concern.

To increase air ventilation further, the inner opening 26 may be opened allowing outside air to freely enter the garment. This third configuration is ideal for high speed riding in hot temperatures where a snug fit of the cuff 50 is important to keep the sleeve 10 from shifting but a higher amount of ventilation is desired. When a snug fit of the cuff 50 is not required, such as during slower riding, and a maximum amount of ventilation is desired, both zipper closures 46 may be moved to the upper end of the outer opening 18. In this fourth configuration the sleeve 10, including the cuff 50 is fully expanded throughout its length, allowing air to flow directly into the sleeve 10 through the loosely fitting cuff 50. The inner opening 26 may or may not be opened in the fourth configuration to increase or decrease the amount of ventilation accordingly. A further function of the fourth configuration is that it allows for easy donning and removal of the garment because the sleeves 10 and cuffs 50 are fully expanded along their lengths such that a wearer may easily pass his or her hands through the sleeves 10 and cuffs 50 of the jacket 8.

What is claimed is:

1. An article of clothing comprising:

an outer fabric layer defining at least one of a sleeve and a pant leg, the outer fabric layer having an outer opening;

an inner fabric layer defining at least one of a sleeve and a pant leg, the inner fabric layer coupled to the outer fabric layer and having an inner opening, the inner fabric layer being substantially waterproof, the outer fabric layer being substantially less waterproof than the inner fabric layer; and a water-resistant closure coupled to the inner fabric layer adjacent the inner opening and accessible through the outer opening.

2. An article of clothing as claimed in claim 1, wherein said outer fabric layer is not waterproof.

3. An article of clothing as claimed in claim 1, wherein said outer fabric layer comprises abrasion-resistant nylon.

4. An article of clothing as claimed in claim 1, wherein said inner fabric layer comprises polymer-coated nylon.

5. An article of clothing as claimed in claim 1, wherein said inner opening is substantially aligned with said outer opening.

6. An article of clothing as claimed in claim 1, wherein said water-resistant closure is movable between an open position, which allows air to pass through the inner opening, and a closed position, which substantially prevents water from passing through the inner opening.

7. An article of clothing as claimed in claim 1, wherein the water-resistant closure comprises a water-resistant zipper.

8. An article of clothing as claimed in claim 1, further comprising a venting material secured to the inner fabric layer and covering at least portion of the inner opening, the venting material allowing passage of air therethrough.

9. An article of clothing as claimed in claim 8, wherein the venting material includes a plurality of holes therethrough.

10. A method of making an article of clothing comprising:

providing an outer fabric layer defining at least one of a sleeve and a pant leg, the outer fabric layer also defining an outer opening;

providing a substantially waterproof inner fabric layer defining at least one of a sleeve and a pant leg, the inner fabric layer defining an inner opening, the outer fabric layer being substantially less waterproof than the inner fabric layer;

providing a water-resistant closure;

coupling the water-resistant closure adjacent the inner opening;

coupling the waterproof inner fabric layer to the outer fabric layer to extend across the outer opening; and accessing the water-resistant closure through the outer opening.

11. The method of claim 10 further comprising:

aligning the inner opening with the outer opening;

providing a venting material; and securing the venting material to the inner fabric layer to cover at least a portion of the inner opening.

12. An article of clothing comprising:

an outer fabric layer defining at least one of a sleeve and a pant leg, the outer fabric layer having an outer opening;

an inner fabric layer defining at least one of a sleeve and a pant leg, the inner fabric layer coupled to the outer fabric layer and having an inner opening, the inner fabric layer being substantially waterproof, the inner fabric layer substantially completely lining the interior of the outer fabric; and a water-resistant closure coupled to the inner fabric layer adjacent the inner opening and accessible through the outer opening.

* * * * *